US005769342A

United States Patent [19]

Makitka

[11] Patent Number: 5,769,342

[45] Date of Patent: Jun. 23, 1998

[54] ERGONOMIC ENDCAP, COLLETS, WINDERS, SYSTEMS AND METHODS OF WINDING FORMING PACKAGES USING THE SAME

[75] Inventor: Harry Makitka, Clemmons, N.C.

[73] Assignee: PPG Industries, Inc., Pittsburgh, Pa.

[21] Appl. No.: 764,375

[22] Filed: Dec. 13, 1996

[51] Int. Cl.[6] ..... B65H 54/00; B65H 75/24

[52] U.S. Cl. ..... 242/18; 242/18 EW; 242/571; 242/573.7

[58] Field of Search ..... 242/18 PW, 18 EW, 242/571, 571.1, 573, 573.7, 573.8, 46.6

[56] References Cited

U.S. PATENT DOCUMENTS

| | | | |
|---|---|---|---|
| 2,215,069 | 9/1940 | Meisel . | |
| 2,891,798 | 6/1959 | Smith . | |
| 3,052,420 | 9/1962 | Roberts | 242/573.7 X |
| 3,544,016 | 12/1970 | Cunningham et al. | 242/18 |
| 3,640,058 | 2/1972 | Hartley, Jr. | 57/34 |
| 3,687,381 | 8/1972 | Cunningham et al. | 242/18 R |
| 3,695,018 | 10/1972 | Angst et al. | 57/34 PW |
| 3,768,242 | 10/1973 | Angst et al. | 57/34 PW |
| 3,871,592 | 3/1975 | Kallenborn | 242/18 G |
| 4,093,137 | 6/1978 | Briar et al. | 242/46.4 |
| 4,106,711 | 8/1978 | Oswald et al. | 242/19 |
| 4,125,229 | 11/1978 | Dillon | 242/18 R |
| 4,154,412 | 5/1979 | Briar et al. | 242/46.4 |
| 4,311,287 | 1/1982 | Evers | 242/573.7 |
| 4,342,430 | 8/1982 | Kasai et al. | 242/18 PW X |
| 4,390,647 | 6/1983 | Girgis . | |
| 4,418,876 | 12/1983 | Sato et al. | 242/18 PW X |
| 4,739,940 | 4/1988 | Fliieli et al. | 242/18 PW |
| 4,760,976 | 8/1988 | Burchette, Jr. | 242/118.11 |
| 4,762,750 | 8/1988 | Girgis et al. . | |
| 4,762,751 | 8/1988 | Girgis et al. . | |
| 4,795,678 | 1/1989 | Girgis . | |
| 4,941,314 | 7/1990 | Odawara | 57/299 |
| 5,156,347 | 10/1992 | Gay, II et al. | 242/18 A |

OTHER PUBLICATIONS

K. Loewenstein, *The Manufacturing Technology of Continuous Glass Fibres*, (3d ed. 1993), pp. 30–44, 47–60, 115–122, 126–135, 165–173, 177–180, 186–190, 219–222, 237–291; (2d ed 1983) pp. 317–323.

Encyclopedia of Polymer Science and Technology, vol. 6 (1967) pp. 505–712.

*Primary Examiner*—Michael Mansen
*Attorney, Agent, or Firm*—Ann Marie Cannoni

[57] ABSTRACT

A radially expandable endcap adapted for mounting upon a mandrel of a collet of a forming package winder. Other aspects of this invention include a collet and winder including the above endcap and method for winding strand using the same. Another aspect of the present invention is a collet having an expandable mandrel on at least a portion of a first end of the collet proximate an operator and distal to a second, opposite end of the collet mounted upon a support Other aspects of this invention are a winder including the above collet and a method for using the same.

16 Claims, 7 Drawing Sheets

ERGONOMIC ENDCAP, COLLETS, WINDERS, SYSTEMS AND METHODS OF WINDING FORMING PACKAGES USING THE SAME

FIELD OF THE INVENTION

The present invention relates to apparatus for winding continuous fiber strand into a forming package and, more particularly, to an ergonomic endcap, collets, systems for winding a forming package and methods for the same.

BACKGROUND OF THE INVENTION

As raw material, labor and waste disposal costs escalate, technological advances provide a competitive means to increase productivity while decreasing cost. In labor intensive industries, advances in ergonomic or labor-saving technology can improve the work environment, as well as provide increased productivity and efficiency.

Technological advances are needed in the labor-intensive forming operations of the fiber glass industry, in which glass fiber strands are wound into forming packages. In the forming area, glass filaments are drawn and gathered into fibers at a high rate of speed from a fiber forming apparatus, or bushing, connected to a supply of molten glass. The fibers are gathered into one or more strands and wound upon a rotating collet of a winder to create a forming package.

At the beginning of the winding operation, an operator typically winds the strand about a non-expandable endcap of a collet and, when proper winding speed is achieved, shifts the strand to wind about an expandable mandrel of the collet to form a forming package. When the forming package is completed, the operator shifts the strand from the mandrel to wind about the endcap and ceases rotation of the collet.

The strand wound about the endcap must be removed from the endcap before removing the forming package from the mandrel. The rotational speed of the collet can exceed six thousand revolutions per minute, thereby subjecting the strand wound about the endcap to high compressive forces. The layers of strand which are tightly wrapped about the endcap can be difficult and time-consuming to remove, typically requiring the operator to sever the strand with a sharp knife. The knives must often be sharpened or replaced due to the abrasive strand material and generally are not ergonomically desirable equipment. Severing the strand will become increasingly difficult in the future as the number of individual filaments in the strand and consequently the strand diameter is increased to improve productivity and efficiency.

For removing waste yarn from a spindle of a draw twisting machine, U.S. Pat. Nos. 3,695,018 and 3,768,242 disclose removable waste cones for mounting at the support base of the spindle. The cones include fingers which move outwardly as the cone is slid downwardly into position at the base of the spindle prior to winding and which retract upon removal from the spindle after winding. Waste fibers are wound about the expanded cone and can be removed when the cone is lifted from the spindle and the fingers are retracted.

U.S. Pat. Nos. 2,891,798, 3,544,016, 3,687,381, 3,871,592, 4,093,137 and 4,154,412, disclose rotatable collets which include a nonexpanding head piece or endcap and a radially expandable mandrel for retaining a forming tube about which a package of fiber strands can be wound. The mandrel can have fingers which are displaced radially outwardly from the mandrel by, for example, centrifugal force or pressurization to thereby expand the diameter of the mandrel. Glass fiber strands are wound upon a removable packaging tube positioned upon the expanded mandrel to form a forming package. The mandrel is collapsed to facilitate removal of the wound forming package.

In a winding operation using such expandable collets, waste strands generated at the beginning or end of the winding process are typically wound upon the non-expandable endcap or a portion of the removable packaging tube which extends over the endcap. As discussed above, removal of waste strand wound about a non-expandable endcap or the end of a packaging tube is difficult. In addition, waste strand wound about the end of the packaging tube can distort the shape of the tube, thereby increasing the possibility of the tube disintegrating during subsequent winding operations. Increased tube wear also decreases recyclability of the tubes. There is a need for a device which facilitates removal of waste strand produced during the winding operation to improve ergonomic efficiency and increase packaging tube longevity.

SUMMARY OF THE INVENTION

The present invention provides an endcap adapted for mounting upon a mandrel of a collet of a forming package winder, the endcap comprising: (a) a hub comprising (1) a mounting device for securing a portion of the hub to an end of a mandrel of a collet about which a generally continuous fiber strand is wound to form a forming package and (2) a plurality of retainers spaced about the periphery of the hub; (b) a plurality of strand engaging members which are radially displaceable from the periphery of the hub, each strand engaging member being retained by a corresponding retainer of the hub; each strand engaging member comprising a strand engaging surface for segregating and retaining a first portion of the strand from a second portion of the strand from which the forming package is wound, each strand engaging member being moveable between (1) an extended position in which the strand engaging surface of the strand engaging member projects from the periphery of the hub during winding of the fiber strand to segregate and retain the first portion from the second portion of the strand during winding and (2) a retracted position adjacent the periphery of the hub which permits removal of the first portion of the strand from the endcap after winding. Other aspects of this invention include a collet, winder and system including the above endcap.

Another aspect of the present invention is a collet comprising an expandable mandrel on at least a portion of a first end of the collet proximate an operator and distal to a second, opposite end of the collet mounted upon a support, the expandable mandrel having a plurality of retainers spaced about the periphery of the mandrel and a plurality of strand engaging members which are radially displaceable from the periphery of the mandrel, each strand engaging member being retained by a corresponding retainer of the mandrel; each strand engaging member comprising a strand engaging surface for contacting, segregating and retaining a first portion of a generally continuous fiber strand from a second portion of the strand from which the forming packagers wound, each strand engaging member being moveable between (1) an extended position in which the strand engaging surface of the strand engaging member projects from the periphery of the mandrel during winding of the fiber strand to contact, segregate and retain the first portion of the strand from the second portion of the strand during winding and (2) a retracted position adjacent the periphery of the mandrel which permits removal of the first portion of the strand from the mandrel after winding. Other aspects of this invention include a winder and a system including the above collet.

Yet another aspect of the present invention is a method for winding a strand of fibers to form a wound forming package, the method comprising: (a) supplying a plurality of generally continuous fibers; (b) gathering the plurality of fibers to form at least one generally continuous fiber strand; (c) extending a strand engaging surface of each of a plurality of strand engaging members radially from the periphery of an endcap of a collet of a forming package winder; (d) winding a first portion of the strand about the strand engaging surface of each of the plurality of strand engaging members of the endcap; (e) winding a second portion of the strand about a mandrel of the collet to form a wound forming package; (f) retracting the plurality of strand engaging members about the periphery of the endcap; (g) removing the first portion of the strand from the strand engaging surfaces of the strand engaging members of the endcap; and (h) removing the wound package from the mandrel.

Another aspect of the present invention is a method for winding a bundle of fibers to form a wound forming package, the method comprising: (a) supplying a plurality of generally continuous fibers; (b) gathering the plurality of fibers to form at least one generally continuous fiber strand; (c) extending a strand engaging surface of each of a plurality of strand engaging members radially from the periphery of a mandrel of a forming package winder; (d) winding a first portion of the strand about the strand engaging surface of each of the plurality of strand engaging members on at least a portion of an end of the mandrel proximate an operator and distal to a support; (e) winding a second portion of the strand about another portion of the mandrel to form a wound package; (f) retracting the plurality of strand engaging members about the periphery of the mandrel; (g) removing the first portion of the strand from the strand engaging surfaces of the strand engaging members of the mandrel; and (h) removing the wound package from the mandrel.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE INVENTION

The endcaps, collets, winders, systems for winding forming packages and methods of winding fiber strands of the present invention are useful in fiber forming operations and represent an economical, ergonomically desirable advance in winder technology which provides increased productivity and efficiency by facilitating winding of fiber strands into forming packages.

To better understand the aforesaid important aspects of the invention, a glass fiber forming operation in which such apparatus and methods are useful will first be discussed. One skilled in the art would understand that the apparatus and methods of the present invention are not intended to be limited to use in glass fiber forming, but are useful in operations for winding a wide variety of natural and man-made fibers, as discussed in detail below.

Figure 1:
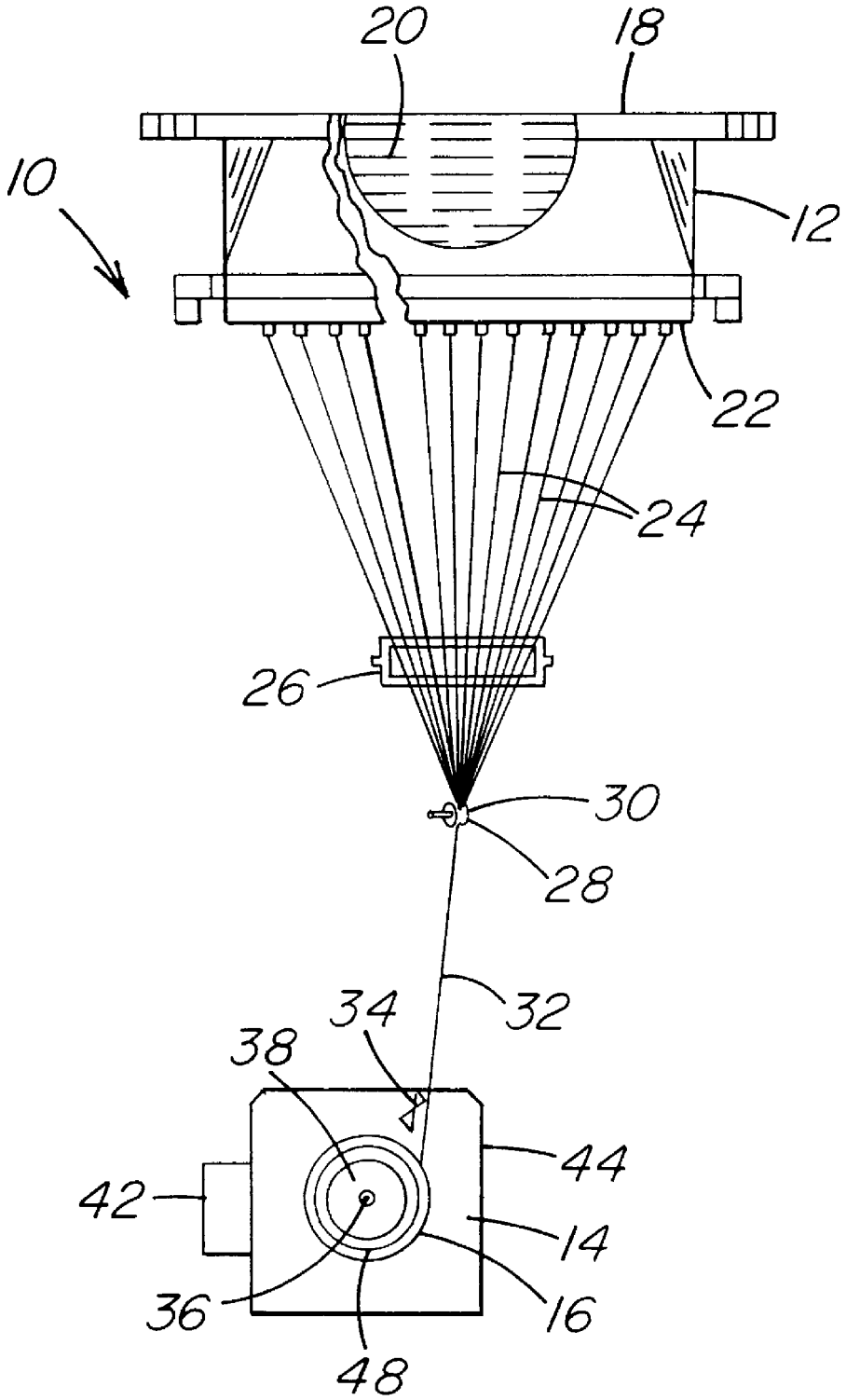
FIG. 1 is a schematic of a front elevational view of a fiber forming apparatus and winder according to the present invention.

Referring to the drawings, wherein like numerals indicate like elements throughout, there is shown in FIG. 1 a system, generally designated 10, comprising a fiber forming apparatus 12 and winder 14 for winding a forming package 16, in accordance with the present invention.

The fiber forming apparatus 12 preferably comprises a glass melting furnace or forehearth 18 containing a supply of a fiber forming mass or molten glass 20 and having a precious metal bushing 22 or spinneret attached to the bottom of the forehearth 18. Alternatively, the fiber forming apparatus 12 can be, for example, a forming device or spinneret for synthetic textile fibers or strands.

As shown in FIG. 1, the bushing 22 is provided with a series of orifices in the form of tips through which molten glass is drawn in the form of individual fibers 24 or filaments at a high rate of speed. The glass fibers 24 can be cooled by spraying with water (not shown) and then coated with a sizing composition by an applicator device 26 which contacts the fibers 24 prior to entering the alignment device 28. The preferred applicator device 26 is a graphite roll applicator as shown in FIG. 1. Other examples of suitable applicator devices 26 are disclosed in K. Loewenstein, *The Manufacturing Technology of Glass Fibres*, (3d Ed. 1993) at pages 165–172, which are hereby incorporated by reference.

After application of the sizing, the glass fibers 24 are gathered by an alignment device 28 which aligns each of the fibers 24 such that each of the fibers 24 is generally adjacent and coplanar (in side-by-side or generally parallel alignment) to each other. Non-limiting examples of suitable alignment devices include rotatable or stationary gathering shoes or a comb, as discussed in Loewenstein at page 173, which is hereby incorporated by reference.

As shown in FIG. 1, the preferred alignment device 28 comprises a plurality of graphite split stationary gathering shoes 30 which gather a plurality of fibers 24 emanating from the bushing 22 to form one or more strands 32 and align the strands 32 in a generally adjacent and coplanar arrangement. Preferably, the number of strands 32 ranges from 1 to about 10 strands and, more preferably, 1 to about 6 strands. Alternatively, the strands 32 can be gathered from a plurality of adjacent bushings.

Referring to FIG. 1, the system 10 also comprises a winder 14 for receiving the strands 32 from the alignment device 28, advancing and applying a tension to the strands 32, and forming the strands 32 into a wound package 16 about the rotational axis 36 of a collet 38 of the winder 14.

Figure 2:
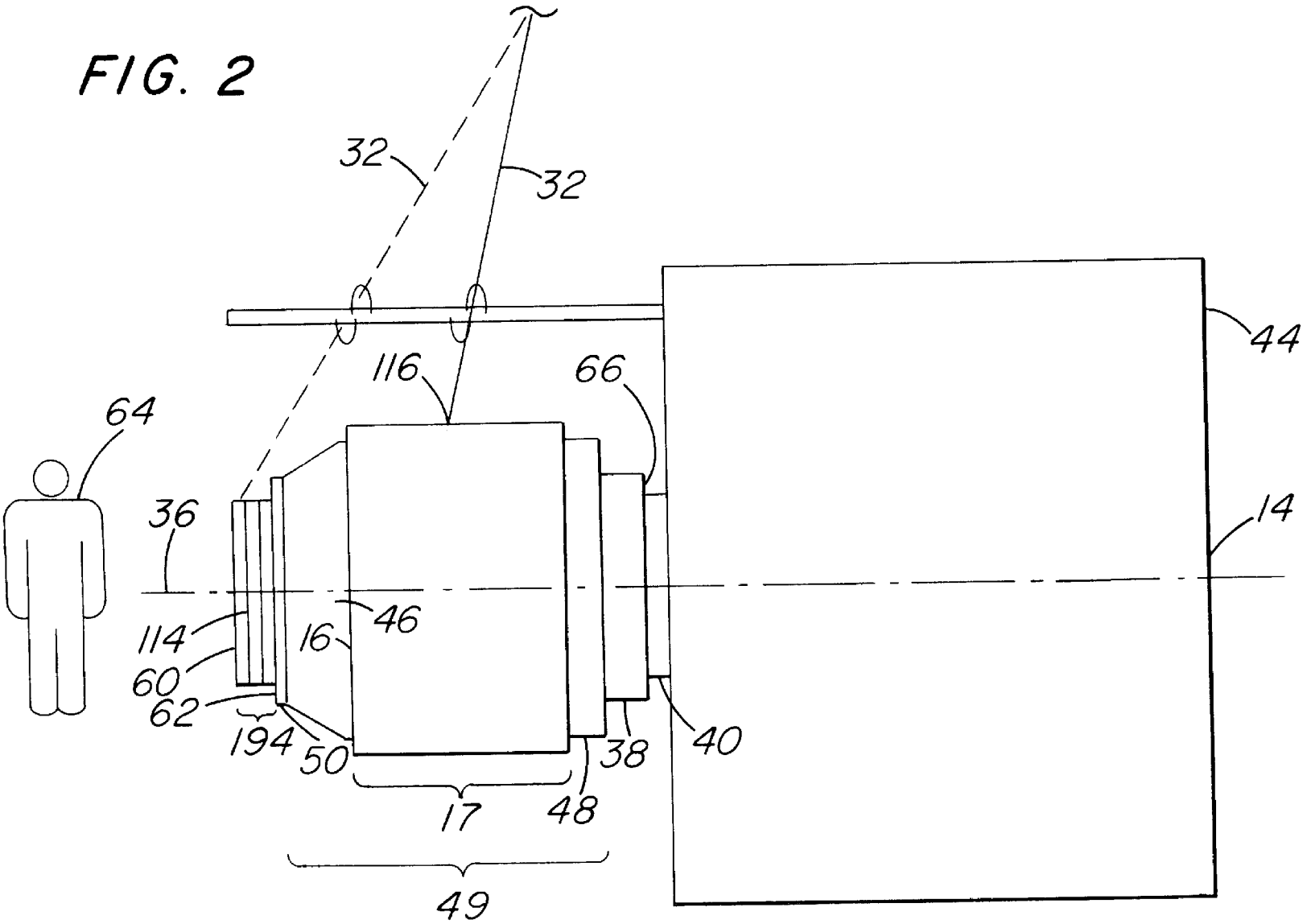
FIG. 2 is a side elevational view of the schematic of the winder portion of FIG. 1.

As shown in FIGS. 1 and 2, the winder 14 comprises a rotatable package collector or collet 38 mounted upon a support or shaft 40 and a motor assembly 42 for rotating the collet 38.

Figure 5:
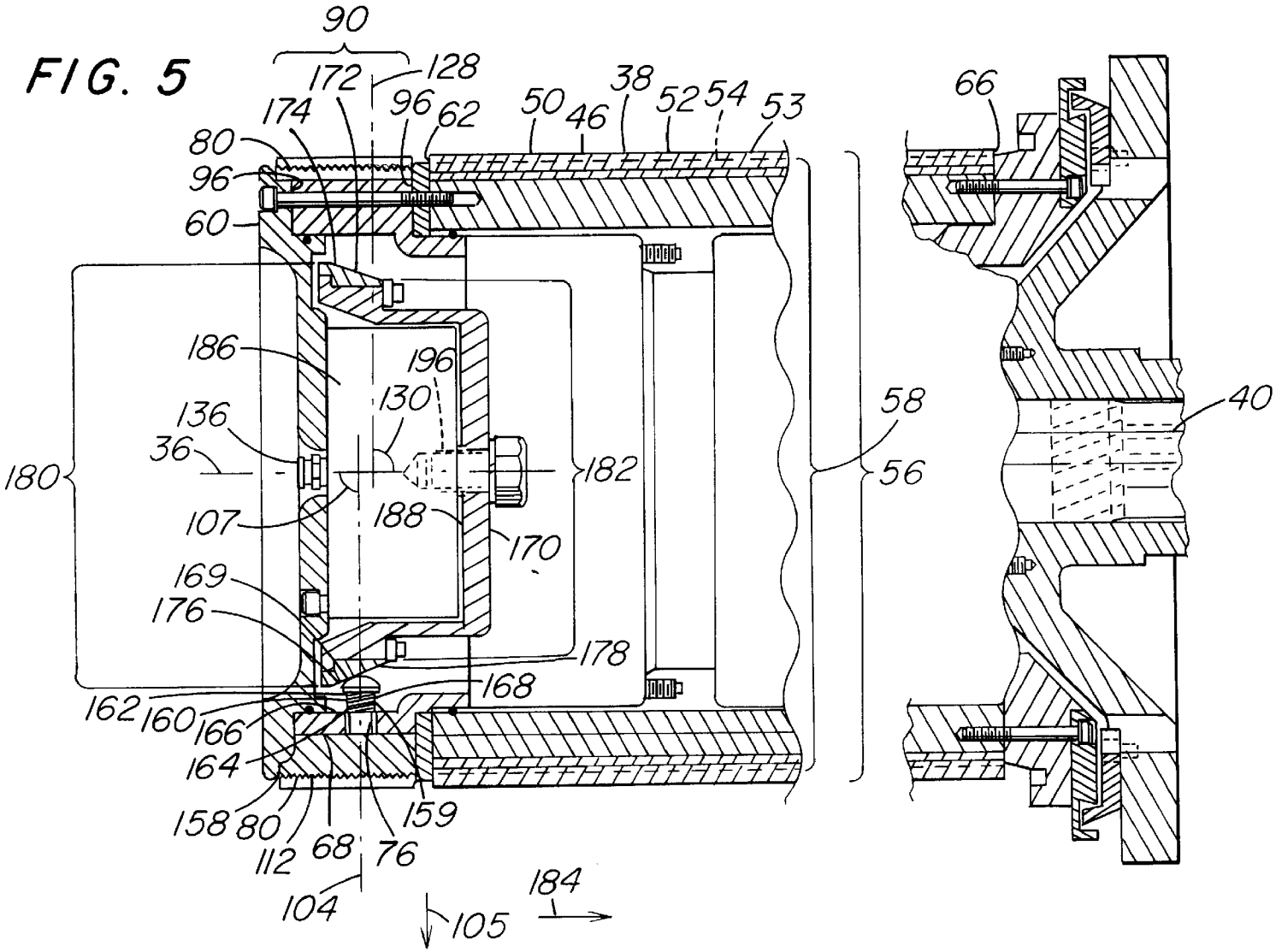
FIG. 5 is a cross-sectional view of a portion of the collet of FIG. 3, taken along lines 5—5 of FIG. 3, according to the present invention.

The collet 38 has a generally cylindrical surface 46 about which the strands 32 are wound to form a forming package 16. Referring now to FIG. 5, the collet 38 comprises a mandrel 50 which receives the strands 32 from the alignment device 28 and provides the generally cylindrical surface 46 upon which the forming package 16 is wound. The mandrel 50 is preferably radially expandable and has a first, expanded position 52 for engaging and retaining the forming package 16 upon the collet 38 and a second, collapsed position 54 (shown in phantom) for releasing the forming package 16 from the mandrel 50. The mandrel 50 can be radially expanded by the centrifugal force generated by the rotating collet and collapsed by ceasing rotation of the collet. Alternatively, compressed air can be used to expand a plurality of fingers 55 positioned radially about the periphery of the mandrel 50. The mandrel 50 can be collapsed by releasing the compressed air. Other methods and apparatus for expanding and collapsing the collet 38 are well known to those skilled in the art and further discussion thereof is not believed to be necessary in view of the present disclosure. For more information, a general discussion of expandable collets and forming winders is given in Loewenstein at pages 177–180 and U.S. Pat. Nos. 3,871,592, 4,093,137 and 4,154,412 which are hereby incorporated by reference.

Figure 3:
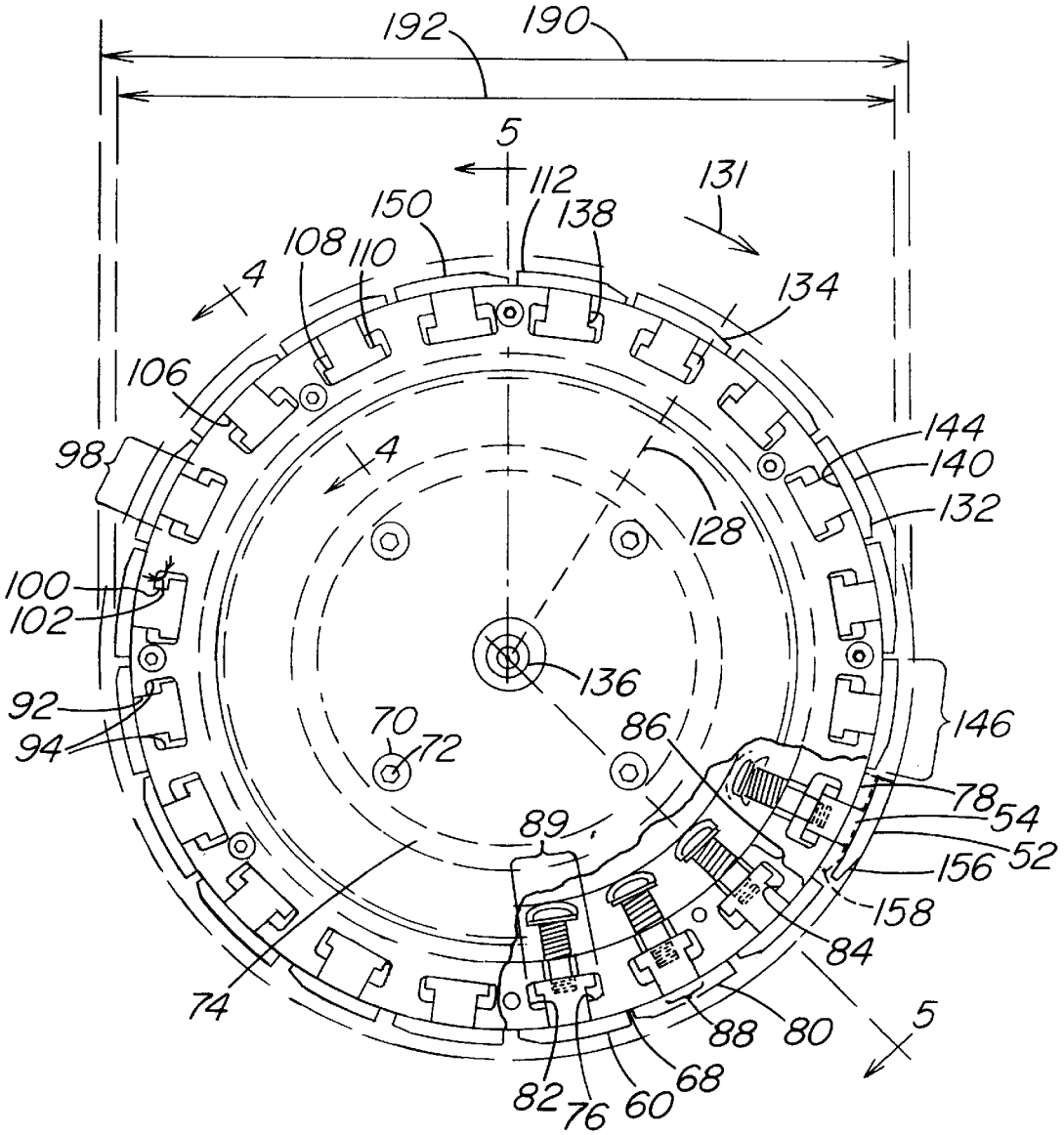
FIG. 3 is a schematic of an end view of a collet having an endcap according to the present invention.

As shown in FIGS. 3 and 5, the mandrel 50 has a first diameter 56 when in the first, expanded position 52 and a second diameter 58 which is less than the first diameter 56 when in the second, collapsed position 54. Preferably, the first diameter 56 ranges from about 0.15 to about 0.51 meters (about 6 to about 20 inches), and more preferably about 0.15 to about 0.30 meters (about 6 to about 12 inches). The second diameter 58 preferably ranges from about 0.14 to about 0.5 meters (about 5.5 to about 19.5 inches), and more preferably about 0.14 to about 0.29 meters (about 5.5 to about 11.5 inches). The first diameter 56 and second diameter 58 can vary, based upon such factors as the type of winder 14 and the desired inner diameter of the wound package 16.

The mandrel 50 and other components of the collet 38 are typically constructed from lightweight materials to permit rapid acceleration and deceleration of the collet 38. Non-limiting example of suitable materials include aluminum, steel and alloys thereof, and preferably 6061-T6 aluminum alloy.

The forming package 16 is preferably wound upon a tubular support 48 which is removably telescoped onto the mandrel 50, as shown in FIGS. 1 and 2. Suitable materials for forming the tubular support 48 include a variety of materials well known to those skilled in the art, such as thermoplastic materials and cardboard. As shown in FIG. 2, the tubular support 48 has a length 49 which is preferably slightly longer than the desired length 17 of the forming package 16, yet preferably does not extend over the endcap 60, which will be discussed in detail below. The inner diameter of the tubular support 48 is generally equal to or slightly greater than the first, expanded diameter 56 of the mandrel 50.

Referring to FIG. 2, in a preferred embodiment the collet 38 comprises an expandable endcap 60 which is adapted to be mounted upon or connected to a first end 62 of the mandrel 50 proximate an operator 64 and distal to a second, opposite end 66 of the mandrel 50 adjacent the support or housing 44. One skilled in the art would understand that the endcap 60 of the present invention is also useful for collets which do not have collapsible mandrels.

Figure 4:
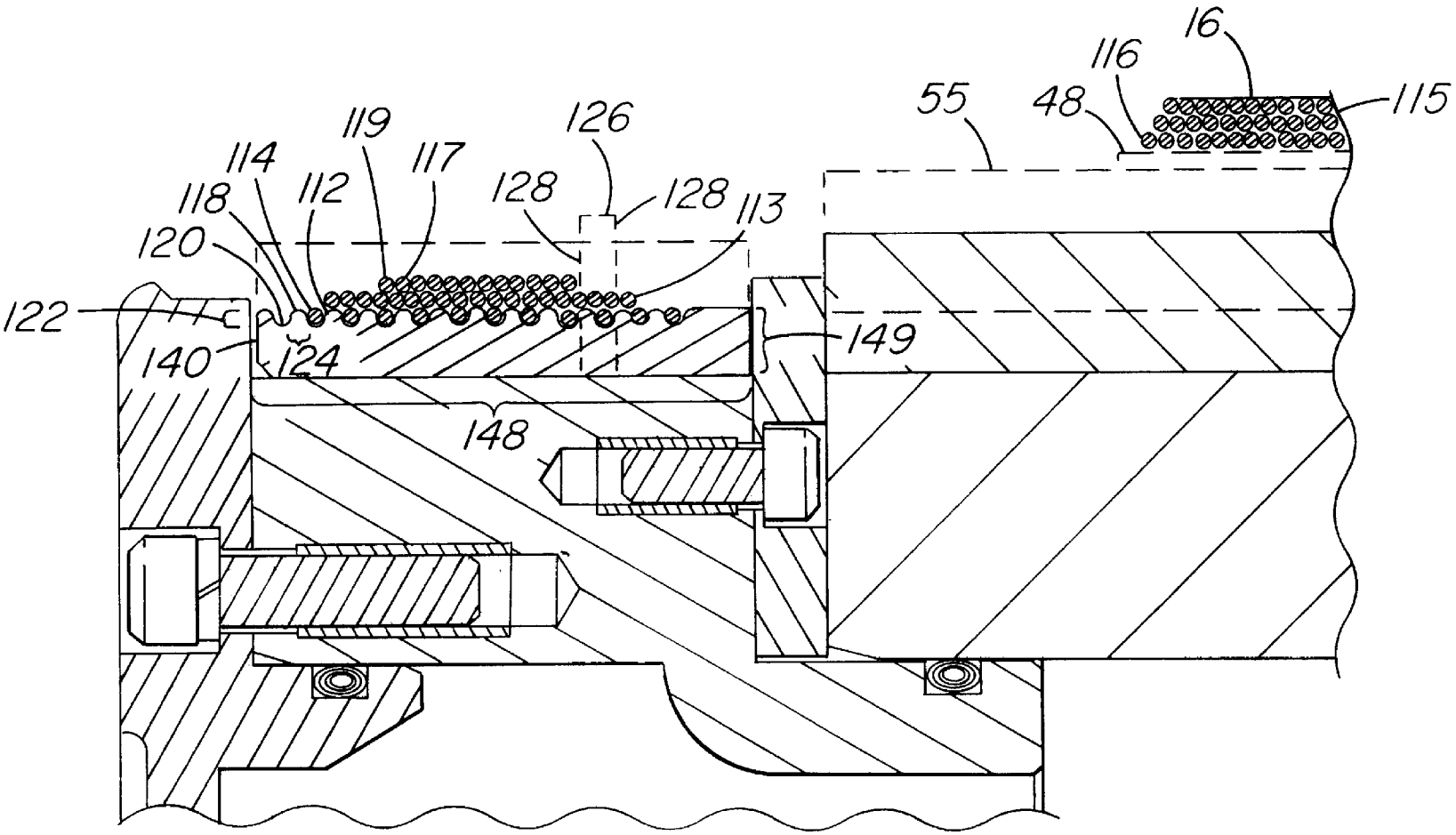
FIG. 4 is an enlarged cross-sectional view of a portion of FIG. 3, taken along lines 4—4 of FIG. 3, showing a strand engaging surface and strand according to the present invention.

Referring to FIGS. 3–5, the endcap 60 comprises a hub 68 which is preferably generally cylindrical and formed from a generally rigid, lightweight material such as are discussed above. A non-limiting example of a suitable metallic material is 6061-T6 aluminum alloy, the composition of which is well known to those skilled in the art. The endcap 60 can be anodized, if desired.

As shown in FIG. 3, the hub 68 comprises a mounting device 70, such as one or more screws 72, for securing a portion 74 of the hub 68 to the first end 62 of mandrel 50. Other suitable mounting devices are well known to those skilled in the art and further discussion thereof is not believed to be necessary in view of the present disclosure.

Referring now to FIGS. 3–5, the hub 68 also comprises a plurality of retainers 76 which are spaced about the periphery 78 of the hub 68. Each of the retainers 76 retains a corresponding strand engaging member 80, the configuration and details of which will be discussed in detail below. Each retainer 76 can be formed as an integral portion of the hub 68, such as for example channels, apertures 82, flanges 84 and/or grooves 210. Other suitable retainers 76 can be attached to the hub 68 and formed from a separate material which is the same or different from the material from which the hub 68 is formed. A non-limiting example of such a retainer 76 is a pin which is received in a recess in the hub 68.

The configuration of each retainer 76 generally corresponds to the configuration of the corresponding strand engaging member 80 to be secured and retained, but permits the strand engaging member 80 to be radially displaced to extend from the periphery 78 of the hub 68.

As shown in FIGS. 3 and 5, the retainer 76 is preferably an aperture 82 configured to retain the corresponding strand engaging member 80. The depth 86 of the aperture 82 preferably ranges from about 13 to about 76 mm (about 0.5 to about 3 inches). The width 88 of the aperture 82 proximate the periphery 78 of the hub 68, shown in FIG. 3, preferably ranges from about 13 to about 51 mm (about 0.5 to about 2 inches). The width 89 of the aperture 82 proximate the retainer 76 is preferably about 19 to about 51 mm (about 0.75 to about 3 inches). The length 90 of the aperture 82 (shown in FIG. 5) preferably ranges from about 203 to about 1524 mm (about 8 to about 60 inches) and more preferably about 638 to about 1270 mm (about 25 to about 50 inches). These dimensions can vary based upon the shape of the strand engaging member 80 to be retained by the aperture 82.

The aperture 82 includes one or more walls 92 which are preferably generally smooth to decrease wear between the strand engaging member 80 and the walls 92, although the walls 92 can include protrusions, indentations or irregularities, if desired. As presently preferred, the aperture 82 has two opposed side walls 94 and two opposed end walls 96 (shown in FIG. 5).

As shown in FIG. 3, the side walls 94 of the preferred aperture 82 include opposed flanges 84 for retaining the strand engaging member 80, such that the aperture 82 is generally T-shaped in cross-section. The diameter 98 of the flange 84 preferably ranges from about 3 to about 51 mm (about ⅛ to about 2 inches).

The retaining surface 100 of the flange 84 can be smooth or have protrusions, indentations or irregularities, if desired. Preferably the angle 102 between the side walls 94 or end walls 96 and the retaining surface 100 is about 90 degrees, although this angle can vary, if desired.

Figure 3A:
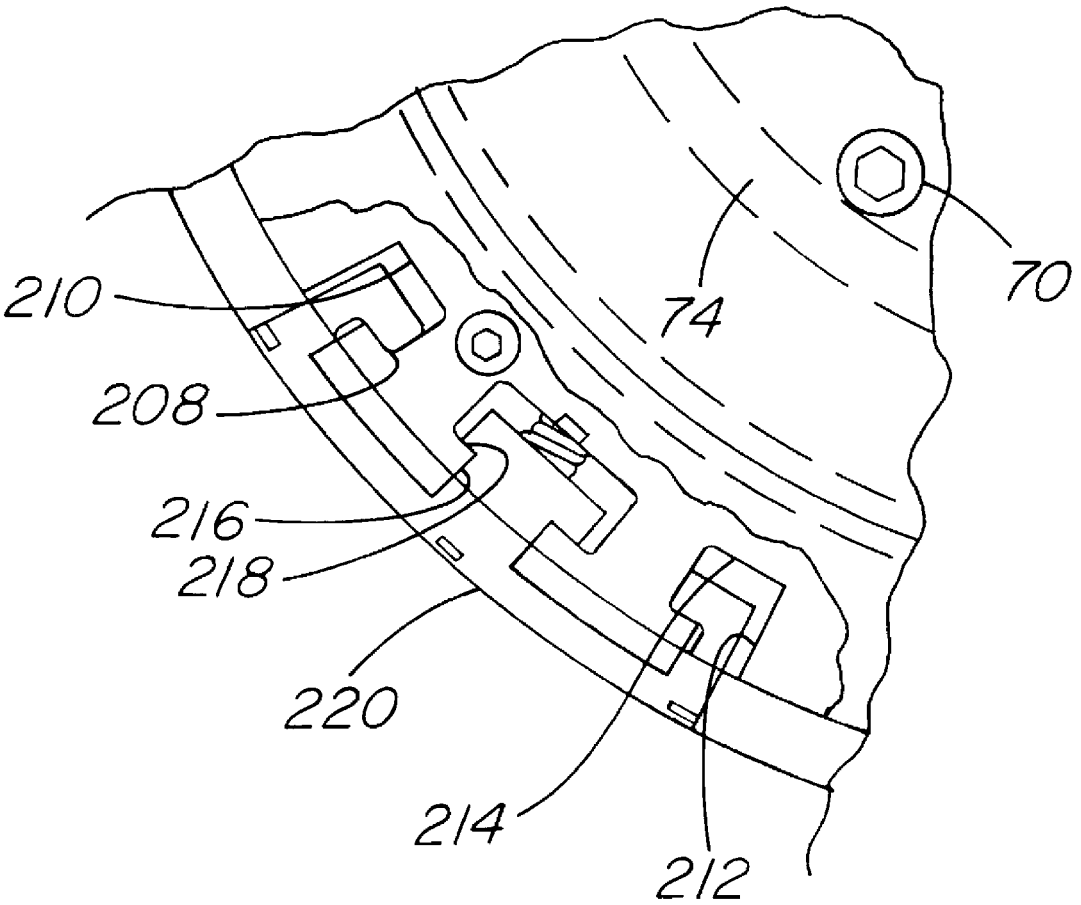
FIG. 3*a* is a schematic end view of a portion of a collet having an alternative embodiment of an endcap according to the present invention.

In an alternative embodiment also shown in FIG. 3*a*, the retainer 208 is a groove 210 which includes one or more walls 212, preferably comprising a bottom wall 214 and a plurality of side walls 216. The groove 210 can be generally E-shaped in cross section, and include one or more flanges 218 for retaining the strand engaging member 220 which corresponds generally in cross-section to the configuration of the groove 210. The strand engaging member 220 can be extended and retracted using a similar mechanism and in a similar manner to the strand engaging member 80 discussed below.

Referring now to a preferred embodiment shown in FIGS. 3–5, the endcap 60 comprises a plurality of strand engaging members 80. The number of strand engaging members 80 depends upon such factors as the circumference of the hub 68 and the dimensions of each strand engaging member 80. The number of strand engaging members 80 can be 2 to about 60, preferably about 10 to about 50, and more preferably 20.

Each of the strand engaging members 80 is retained by the corresponding retainer 76 and is radially displaceable from the periphery 78 of the hub 68. As used herein, "radially displaceable" means that at least a portion of each strand engaging member 80 is capable of being displaced from the periphery 78 of the hub 68 along an axis 104 (shown in FIG. 5) which bisects the strand engaging member 80 in a direction indicated by arrow 105 which is generally perpendicular to the rotational axis 36 of the collet 38. Preferably the angle 107 between the axis 104 and the rotational axis 36 of the collet 38 is about 90 degrees.

Referring to FIGS. 3 and 5, each of the strand engaging members 80 is configured to be received by the corresponding retainer 76. Preferably, each strand engaging member 80 is generally T-shaped in cross-section and comprises a body 106 having one or more flanges 108. Each flange 108 has a retaining surface 110 corresponding generally in configuration to the retaining surface 100 of the flange 84 of the corresponding retainer 76. The retaining surface 110 of the flange 108 can be smooth or have protrusions, indentations or irregularities corresponding to those of the retaining surface 100 of the flange 84.

Referring to FIGS. 2–4, the body 106 of each strand engaging member 80 also comprises a strand engaging surface 112 spaced apart from the flange 108 for contacting, segregating and retaining one or more layers 113 of a waste or first portion 114 of the strand 32 which are wound about the endcap 60 during the start-up of the winding process from one or more layers 115 of a second portion 116 of the strand 32 which are wound about the mandrel 50 during the winding process to form the forming package 16. If desired, the strand engaging surface 112 can also be used to segregate and retain one or more layers 119 of a waste or third portion 117 of the strand 32 which is wound about the endcap 60 after winding of the forming package 16.

As best shown in FIG. 4, the strand engaging surface 112 preferably has protrusions 118 (such as ridges) or indentations 120 (such as grooves) which segregate and retain the first portion 114 of the strand 32 from the second portion 116 of the strand 32. The number of protrusions can range from 1 to about 50, preferably ranges from about 5 to about 25 and more preferably is 18. Preferably the protrusions 118 have an inverted, generally "U"-shaped cross-section, although the protrusions 118 can be configured in an inverted "V" shape or any shape which retains and segregates the first portion 114 and/or third portion of the strand 32 from the second portion 116 of the strand.

The height 122 of the protrusions 118 (or depth of the indentations 120) can vary based upon such factors as the diameter of the strands 32 to be retained and the number of strands 32. Generally, the height 122 of the protrusions 118 (or depth of the indentations 120) can range from about 0.8 to about 13 mm (about 1/32 to about 1/2 inch), and preferably about 0.8 to about 3 mm (about 1/32 to about 1/8 inch). Also, one or more of the protrusions 118 of a single strand engaging member 80 can have varying heights 122, if desired.

The width 124 of the protrusions 118 can also vary based upon such factors as the diameter of the strands 32 to be retained and the number of strands 32. Generally, the width 124 of the protrusions 118 ranges from about 0.8 to about 25 mm (about 1/32 to about 1 inch), and preferably about 0.8 to about 3 mm (about 1/32 to about 1/8 inch). The protrusions 118 can have different widths 124, if desired.

The distance 126 between the longitudinal axis 128 of adjacent protrusions 118 can vary based upon such factors as are discussed above with respect to the height 122 and width 124, and generally ranges from about 1.6 to about 13 mm (about 1/16 to about 1/2 inch). The distances 126 between different protrusions 118 can vary, if desired.

The longitudinal axis 128 of the protrusions 118 or indentations 120 is preferably oriented generally perpendicularly to the rotational axis 36 of the collet 38. However, one skilled in the art would understand that the longitudinal axis 128 can be oriented at an angle 130 with respect to the rotational axis 36 of the collet 38, as shown in FIG. 5, depending upon the configuration of the protrusions 118 and indentations 120. Generally, this angle 130 can be about 80 to about 120 degrees, and is preferably about 90 degrees.

As shown in FIG. 3, preferably at least a portion 132 of the strand engaging surface 112 is angled with respect to the longitudinal axis 128 of the protrusions 118 in the direction of rotation indicated by arrow 131 to prevent strand breakage. The angle 134 between the portion 132 and longitudinal axis 128 of the strand engaging surface 112 can be about 5 to about 20 degrees, and is preferably about 15 degrees.

The strand engaging surface 110 is connected to the flange 108 by the body 106, the configuration of which corresponds generally to the configuration of the aperture 82. The body 106 has at least one side 138 which is preferably generally smooth, although the side 138 can have protrusions or indentations which correspond generally to those of the wall 92 of the groove 84. Preferably the body 106 comprises a plurality of sides 138, such as for example the four sides shown in FIGS. 4 and 5, or the body 106 can have a single side 138 to provide a generally cylindrical body 106.

Referring to FIG. 4, the body 106 comprises a first portion 140 which extends beyond the periphery 78 of the hub 68 and supports and includes the strand engaging surface 112, such that the strand engaging surface 112 protrudes from the periphery 78 of the hub 68. The first portion 140 includes a bottom 144 which is preferably supported by the periphery 78 of the hub 68 when the strand engaging member 80 is in the retracted position 158. The dimensions of the bottom 144 depend upon such factors as the dimensions of the aperture 82, the desired dimensions of the strand engaging surface 112 and the desired distance between strand engaging members 80. The length 146 of the bottom 144 can be about 25 to about 100 mm (about 1 to about 4 inches). The width 148 of the bottom 144 can be about 25 to about 100 mm (about 1 to about 4 inches).

Referring now to FIG. 3, the first portion 140 also includes at least one side 150 extending between the bottom 144 and the strand engaging surface 112. The side 150 is preferably generally smooth, although the side can include protrusions or indentations, as desired. Preferably, the first portion 140 includes a plurality of sides 150, such as the four sides 150 shown in FIGS. 4 and 5. The length and width of each side 150 corresponds generally to the length 146 and width 148, respectively, of the bottom 144. The height 149 of the side 150 generally ranges from about 1 mm to about 5 mm.

As shown in FIG. 3, the strand engaging members 80 of the endcap 60 are moveable between an extended position 156 and a retracted position 158. In the extended position 156, the strand engaging surface 112 of the strand engaging member 80 extends or projects from the periphery 78 of the hub 68 during winding of the fiber strand 32 to contact, segregate and retain the first portion 114 and/or third portion 117 of the strand 32 from the second portion 116 of the strand 32 during winding. In the retracted position 158, the strand engaging members 80 are positioned adjacent the periphery 78 of the hub 68 such that the bottom 144 is supported by the periphery 78 of the hub 68 to permit removal of the first portion 114 and/or third portion 117 of the strand 32 from the endcap 60 after the winding operation has ceased.

The strand engaging members 80 can be moved between the extended and retracted positions by any method well known to those skilled in the art suitable for expanding and collapsing a mandrel 50, as discussed above.

Referring now to FIG. 5, in a preferred embodiment, to extend and retract the strand engaging members 80 the body 106 comprises a second portion 159 which comprises a biasing device 160 for biasing each strand engaging member 80 in the retracted position 158 in which each strand engaging member 80 is proximate the periphery 78 of the hub 68. The second portion 159 extends from the bottom 144 of the first portion 140 and includes the flanges 108.

As shown in FIGS. 3 and 5, the biasing device 160 preferably comprises a spring-loaded shoulder bolt including a compressible spring 162 having a predetermined spring constant. The spring 162 can be formed from such materials as high carbon steel and stainless steel, for example. The spring constant depends upon such factors as the weight of the strand engaging member 80.

The preferred compressible spring 162 has a 12.2 mm (0.48 inch) outer diameter, a 16 mm (0.63 inch) uncompressed length and a spring constant of 501 kilograms/meter (28 pounds per inch), and is commercially available from Diamond Spring Co. Using a compressible spring as a biasing device is advantageous because springs having different resistances can be interchanged to permit successive winding using a variety of different members 80 selected to accommodate different strands.

One skilled in the art would understand that any suitable biasing device well known to those skilled in the art, such as a piston and cylinder arrangement, can be used as the biasing member. Movement of the piston is regulated by changes in the fluid, such as air or oil, in the cylinder.

As shown in FIG. 5, the first end 164 of the spring 162 abuts or is connected to the inner periphery or wall 166 of the hub 68. The second end 168 of the spring 162 abuts the base of the cap 169 of the shoulder bolt which abuts or is connected to a pressurizing device 170. The pressurizing device 170 comprises a truncated, generally conical ring or member 172 having a tapered outer wall 174. The member 172 has a first end 176 and a second, opposite end 178. The diameter 180 of the member 172 at its first end 176 is greater than the diameter 182 of the member 172 at its second end 178. The member 172 is positioned within the hub 68 such that the outer wall 174 of the member 172 is proximate the inner wall 166 of the hub 68 and contacts the second end 168 of each of the springs 162.

Before winding the strand 32 about the collet 38, the strand engaging members 80 are moved from the retracted position 158 to the extended position 156 by moving the first end 176 of the member 172 into contact with cap 169 at the second end 168 of each of the springs 162 to compress the springs 162. The compressive force on each of the springs 162 causes the corresponding strand engaging member 80 to move radially outwards from the rotational axis 36 of the collet 38 in the direction indicated by arrow 105. Preferably, each spring 162 is essentially fully compressed during the winding operation. The compressive force needed to compress the spring is a function of the spring constant and dimensions of the spring and can be varied as desired.

To compress the springs 162, the first end 176 of the member 172 is moved in a direction indicated by arrow 184 along the rotational axis 36 of the collet 38 by injecting a fluid, such as air or oil, through a valve 136 to compress a piston and cylinder arrangement, such as a hydraulic cylinder or preferably a pneumatic cylinder 186, to apply pressure to the housing 188 connected to the first end 176 of the member 172. A preferred piston and cylinder arrangement suitable for use in the present invention is a spring-loaded return pneumatic cylinder which is commercially available from Bimba, Inc. of Monel, Ill. Suitable valves are commercially available from Tidland Valve. The pressure to be exerted upon the cylinder rod 196 connected to the housing 188 can vary and depends upon such factors as the number of springs 162 to be compressed, the spring constant and configuration of each of the springs 162 and the weight of the member 172. In the preferred embodiment shown in FIGS. 1–5, about $5.5\times10^5$ to about $6.2\times10^5$ pascals (about 80 to about 90 psia) of air is sufficient to move the first end 176 of the member 172 such that the springs 162 are compressed and the strand engaging members 80 are moved from the retracted position 158 to the expanded position 156.

To retract the strand engaging members 80 after winding has ceased, the pressure in the cylinder 186 is reduced such that the member 172 is moved in a direction along the rotational axis 36 of the collet 38 opposite to that direction which is indicated by arrow 184 and the second end 178 of the member 172 contacts the second end 168 of each of the springs 162 to decompress the springs 162.

Other methods and apparatus for extending and retracting the strand engaging members 80 are well known to those skilled in the art and further discussion thereof is not believed to be necessary in view of the present disclosure.

As shown in FIG. 3, when the strand engaging members 80 are in the extended position 156, the endcap 60 can have a diameter 190 which is greater than or equal to the diameter 56 of the mandrel 50 during winding, but preferably the diameter 190 of the endcap 60 is less than the diameter 52 of the mandrel 50 during winding. The diameter 190 of the endcap 60 in the extended position 156 ranges from about 0.2 to about 1 meters, and is preferably about 0.3 meters.

When the strand engaging members 80 are in the retracted position 158, the endcap 60 generally has a diameter 192 which is less than the diameter 54 of the collapsed mandrel 50 to facilitate removal of the wound forming package 16 from the mandrel 50. Generally, the diameter 192 of the endcap 60 in the retracted position 158 ranges from about 10 to about 50 millimeters (mm) less than the diameter 190 of the endcap 60 when in the extended position 156.

Referring now to FIG. 2, the length 194 of the endcap 60 can be about 50 to about 200 mm, and is preferably about 65 mm. The length 194 can vary as desired depending upon such factors as the diameter and number of the strands to be wound.

The endcap 60 of the present invention can be used with other conventional winders for forming packages, such as are discussed in K. Loewenstein, *The Manufacturing Technology of Continuous Glass Fibres* (2d Ed. 1983) at pages 317–323.

Figure 6:
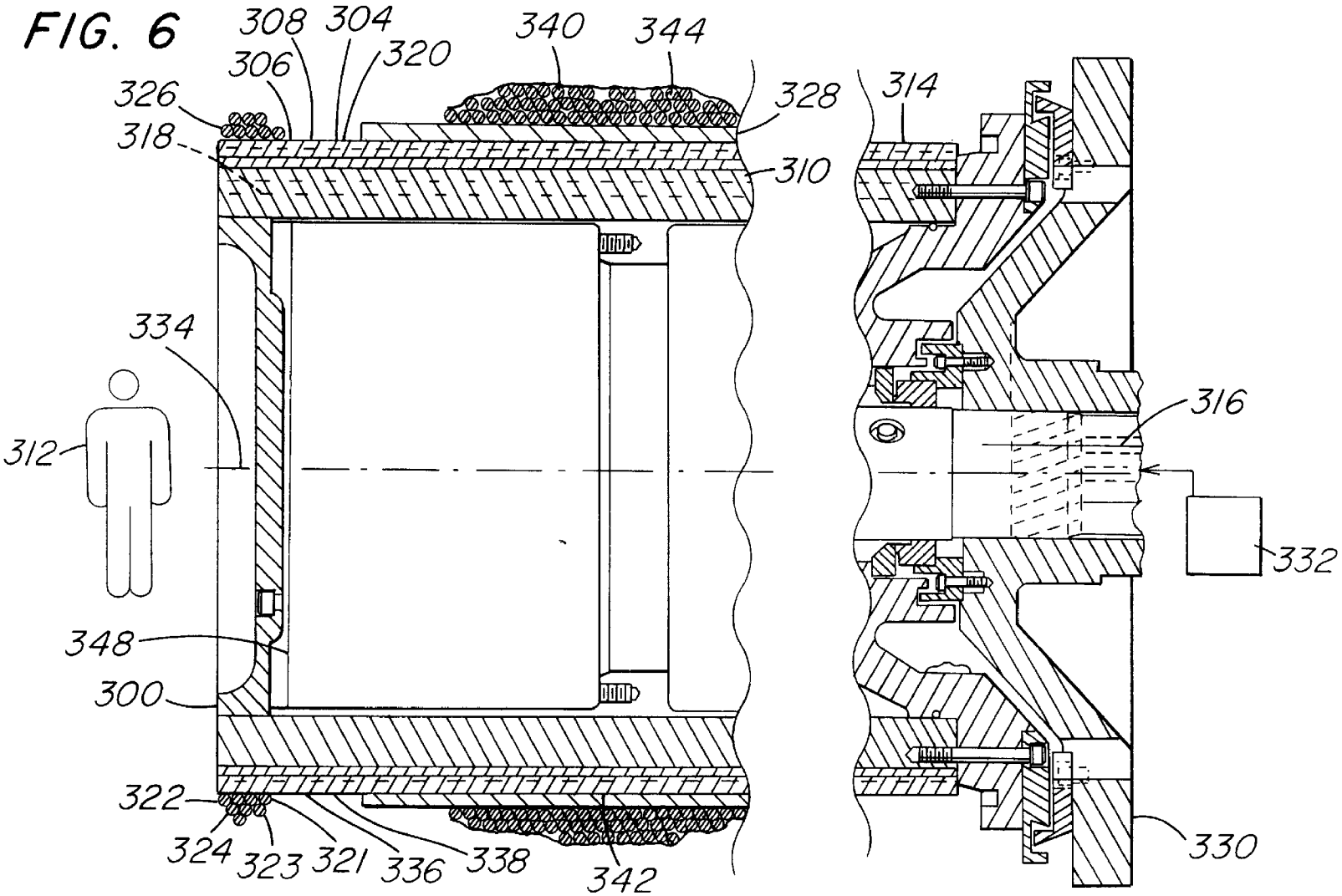
FIG. 6 is a schematic of a cross-sectional view of an alternative embodiment of a collet, according to the present invention.

In an alternative embodiment shown in FIG. 6, the endcap 300 is not expandable but the collet 310 has an expandable mandrel 304 on at least a portion 306 of a first end 308 of the collet 310 proximate the operator 312 and distal to a second, opposite end 314 of the collet 310 mounted upon a support or shaft 316. The expandable mandrel 304 has a plurality of radially displaceable retainers 318 such as are discussed above spaced about its periphery-and corresponding strand engaging members 320 also as discussed above. In this alternative embodiment, one or more layers 321 of the waste first portion 322 and one or more layers 323 of the waste third portion 324 of the strand 326 are wound directly upon the first end 308 of the collet 310 proximate the operator 312 and spaced apart from a second portion 340 of the strand 326 which is wound upon a tubular support 328.

By winding the first portion 322 and/or third portion 324 of the strand 326 directly upon the first end, 308 of the collet 310 rather than upon the tubular support 328, damage to the tubular support 328 is reduced, thereby prolonging its useful life and inhibiting its disintegration during winding.

Referring to both embodiments discussed above, the winder 14, 330 comprises a shaft 40, 316 which is formed from a generally rigid material, such as are discussed above. The shaft 40, 316 is configured in a manner well known to those skilled in the art to support the collet 38, 310, endcap 60, 300 and the forming package 16, 344. As shown in FIGS. 1 and 2, the shaft 40 is connected to the housing 44 of the winder 14 and, in the alternative embodiment shown in FIG. 6, the shaft 316 can be connected to a motor assembly 332 for rotating the shaft 316. Suitable apparatus for mounting the collet 38, 310 upon the shaft 40, 316 and connecting the shaft 40 to the housing 44 are well known to those skilled in the art and further discussion thereof is not believed to be necessary in view of the present disclosure.

The winder 14, 330 also comprises a motor assembly 42, 332 for rotating the collet 38, 310 about the rotational axis 36, 334 of the collet 38, 310. The motor assembly 42, 332 is selected to provide acceleration from rest to full operating speed in about 10 to about 20 seconds and braking to rest in about the same amount of time. During winding, the collet 38, 310 is typically rotated at a speed of about 1000 to about 7000 revolutions per minute to provide a strand attenuation rate of about 900 to about 6500 meters per minute.

In the preferred embodiment shown in FIGS. 3–5, the motor assembly 42 comprises a variable speed motor such as are well known to those skilled in the art. Referring to FIGS. 3 and 4, in the preferred embodiment the motor assembly 42 is an inverted motor which rotates the collet 38 about a stationary shaft 40. In the preferred motor assembly 42, the stationary shaft 40 is surrounded by a stator element (not shown) and a rotor (also not shown). The windings of the stator are connected to a suitable power source, such as a conventional alternating current motor of about 5 to about 50 horsepower. Alternatively, the motor assembly 332, shown in FIG. 1, can be used to rotate a shaft 316, which in turn rotates the collet 310.

The components and operation of suitable motor assemblies 42, 332 useful in the present invention are well known to those skilled in the art and further discussion thereof is not believed to be necessary in view of the present disclosure.

As discussed generally above, the systems for winding a forming package of the present invention include a plurality of fibers from which the wound package 16, 344 is formed. As used herein, the term "fibers" means a plurality of individual filaments or a plurality of strands. The term "strand" as used herein refers to a plurality of individual filaments.

The present invention is generally useful in the winding of fibers, strands, yarns or the like of natural or man-made materials. Fibers believed to be useful in the present invention and methods for preparing and processing such fibers are discussed at length in the *Encyclopedia of Polymer Science and Technology*, Vol. 6 (1967) at pages 505–712, which is hereby incorporated by reference.

Suitable natural fibers include those derived directly from animal, vegetable and mineral sources. Suitable natural inorganic fibers include glass and polycrystalline fibers, such as ceramics including silicon carbide, and carbon or graphite.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Preferred glass fibers are formed from E-glass. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, "The Manufacturing Technology of Glass Fibres", (3d Ed. 1993) at pages 30–44, 47–60, 115–122 and 126–135, which are hereby incorporated by reference.

Non-limiting examples of suitable animal and vegetable-derived natural fibers include cotton, cellulose, natural rubber, flax, ramie, hemp, sisal and wool. Suitable man-made fibers can be formed from a fibrous or fiberizable material prepared from natural organic polymers, synthetic organic polymers or inorganic substances. As used herein, the term "fiberizable" means a material capable of being formed into a generally continuous filament, fiber, strand or yarn.

Suitable man-made fibers include those produced from natural organic polymers (regenerated or derivative) or from synthetic polymers such as polyamides, polyesters, acrylics, polyolefins, polyurethanes, vinyl polymers, derivatives and mixtures thereof.

Further examples of fiberizable materials believed to be useful in the present invention are fiberizable polyimides, polyether sulfones, polyphenyl sulfones, polyetherketones, polyphenylene oxides, polyphenylene sulfides, polyacetals, synthetic rubbers and spandex polyurethanes.

It is understood that blends or copolymers of any of the above materials and combinations of fibers formed from any of the above materials can be used in the present invention, if desired.

Preferably, one or more coating compositions are present on at least a portion of the surfaces of the glass fibers to protect the surfaces from abrasion during processing. Non-limiting examples of suitable coating compositions include sizing compositions and secondary coating compositions. As used herein, the terms "size", "sized" or "sizing" refer to the aqueous composition applied to the filaments immediately after formation of the glass fibers. The term "secondary coating" refers to a coating composition applied secondarily to one or a plurality of strands after the sizing composition is applied, and preferably at least partially dried.

Typical sizing compositions can include as components film-formers, lubricants, coupling agents and water, to name a few. Examples of suitable sizing compositions are set forth in Loewenstein at pages 237–291 and U.S. Pat. Nos. 4,390,647 and 4,795,678, each of which is hereby incorporated by reference.

The sizing can be applied in many ways, for example by contacting the filaments with a static or dynamic applicator, such as a roller or belt applicator, spraying or other means. See Loewenstein at pages 165–172, which are hereby incorporated by reference.

The sized fibers are preferably dried at room temperature or at elevated temperatures. Drying of glass fiber forming packages or cakes is discussed in detail in Loewenstein at pages 219–222, which are hereby incorporated by reference. For example, the forming package can be dried in an oven at a temperature of about 104° C. (220° F.) to about 160° C. (320° F.) for about 10 to about 24 hours to produce glass fiber strands having a dried residue of the composition thereon. The temperature and time for drying the glass fibers will depend upon such variables as the percentage of solids in the sizing composition, components of the sizing composition and type of glass fiber. The sizing is typically present on the fibers in an amount between about 0.1 percent and about 5 percent by weight after drying.

After drying, the sized glass strands can be gathered together into bundles of generally parallel fibers or roving and can be further treated with a secondary coating composition which is different from the sizing composition. As used herein, the term "bundle" refers to a plurality of fibers. The secondary coating composition can include film-formers and lubricants, and is preferably aqueous-based. Non-limiting examples of suitable secondary coating compositions are disclosed in U.S. Pat. Nos. 4,762,750 and 4,762,751, which are hereby incorporated by reference.

The secondary coating composition can be conventionally applied by dipping the strand in a bath containing the composition, by spraying the composition upon the strand or by contacting the strand with a static or dynamic applicator such as a roller or belt applicator, for example.

With reference to FIGS. 1–5, a preferred method for winding one or more strands of fibers to form a wound forming package generally comprises an initial step of supplying a plurality of fibers 24 to the system 10. The fibers 24 are supplied to the system 10 by drawing the fibers 24 from a fiber forming apparatus 12. A sizing composition can be applied to the fibers 24 by an applicator device 26. The fibers 24 are gathered by an alignment device 28 to form at least one continuous fiber strand 32, as discussed above.

The strand engaging surface 112 of each of a plurality of strand engaging members 80 is extended radially from the periphery 78 of the endcap 60 of a collet 38 of a forming package winder 14. One or more layers 113 of a first, waste portion 114 of the strand 32 is wound about the strand engaging surface 112 of each of the plurality of strand engaging members 80 of the endcap 60. Rotation of the collet 38 is commenced and the collet 38 expanded. When the proper winding speed is attained, the strand 32 is shifted from winding about the endcap 60 to wind about the mandrel 50 (or tubular support 48 encasing the mandrel 50, if present). The second portion 116 of the strand 32 is wound about the mandrel 50 of the collet 38 to form a wound forming package 16. When the forming package 16 is complete, the strand 32 can be shifted from winding about the mandrel 50 to wind about the endcap 60 to decelerate and stop the collet 38 and end the winding operation. The one or more layers 119 of the third, waste portion 117 of the strand 32 can be wound about the first portion 114 of the strand 32 upon the endcap 60. The plurality of strand engaging members 80 is then retracted and the first portion 114 of the strand 32 is removed from the strand engaging surface 112 of each strand engaging member 80 of the endcap 60 by an operator 64. The wound package 16 is then removed from the collapsed mandrel 50 by the operator 64.

In an alternative embodiment in which a turret winder is used, the third, waste portion 117 of the strand 32 can be transferred automatically to wind about an expanded endcap 60 of the present invention on another collet to form a second wound package. Such conventional turret winders are well known to those skilled in the art. If more information is needed, see Loewenstein at pages 186–190, which is hereby incorporated by reference.

With reference to FIGS. 1 and 6, in an alternative method a plurality of fibers is supplied to the system and gathered into at least one continuous fiber strand 326 as discussed above. A strand engaging surface 336 of each of a plurality of strand engaging members 320 is extended radially from the periphery 338 of a mandrel 304 of a forming package winder 330. One or more layers of a first portion 322 of the strand 326 is wound directly upon the strand engaging surface 336 of each of the plurality of strand engaging members 320 on at least a portion 306 of an end 308 of the mandrel 304 proximate an operator 312 and distal to a support 316. When the proper winding speed is attained, the strand 326 is shifted to wind about another portion 342 of the mandrel 304 distal to the operator 312. The second portion 340 of the strand 326 is wound about the portion 342 of the mandrel 304 to form a wound forming package 344. When the forming package 344 is completed, if desired, one or more layers of a third portion 324 of the strand 326 can be wound about the first portion 322 of the strand 326. The plurality of strand engaging members 320 about the periphery 338 of the mandrel 304 is retracted and the first portion 322 and/or third portion 324 of the strand 326 is removed from the strand engaging surface 336 of each strand engaging member 320 of the endcap 300 by an operator 312. The wound forming package 344 is then removed from the mandrel 304 by the operator 312.

The operation of the system 10 to perform the process according to the present invention will now be described. However, other apparatus than that shown and described herein could be used to perform the method of the present invention, if desired.

One or more tubular supports 48 are telescoped onto the surface 46 of the mandrel 50 by an operator 64. Pressure is supplied through valve 136 to cylinder 186 and cylinder rod 196 to force housing 188 to move in the direction indicated by arrow 184 causing the first end 176 of member 172 to compress springs 162 and radially expand the diameter 190 of the endcap 60 by extending the strand engaging members 80.

Fibers 24 are drawn from a fiber forming apparatus 12, preferably coated with a sizing composition, and gathered into one or more strands 32 by threading through an alignment device 26. The strands 32 are wrapped around the periphery 78 of the endcap 60 in contact with the strand engaging surface 112 of each strand engaging member 80 by the operator 64. The motor assembly 42 is energized and rotation of the collet 38 is commenced. When the rotational speed of the collet 38 reaches the desired winding speed, the strands are contacted by a spiral assembly 34 and the strand 32 is wound about the surface 46 of the mandrel 50 to form the wound forming package 16.

When winding of the forming package 16 is completed, the strand 32 is displaced from contact with the spiral assembly 34 and wound about the periphery 78 of the endcap 60 in contact with the strand engaging surface 112 of each strand engaging member 80. The operator 64 ceases the winding operation by stopping the rotation of the collet 38 and reducing or releasing the pressure from the cylinder 186 to retract strand engaging members 80 of the endcap 60 and retract the mandrel. The operator 64 severs the strand wound about the endcap 60 from that of the forming package 16 and removes the waste strand from the endcap 60 and the forming package 16 from the mandrel 50.

In an alternative embodiment in which the endcap is not expandable, the system is operated as above except as follows. The tubular support 328 is telescoped onto the surface 305 of the mandrel 304 by an operator 312 and positioned such that the tubular support 328 does not cover the first end 308 of the mandrel 304. Pressure is supplied to expand the strand engaging members 320 of the mandrel 304. The strands 326 are wrapped by the operator 64 around the periphery 338 of the mandrel 304 at the first end 308 thereof in contact with the strand engaging surface 336 of each strand engaging member 320. The motor assembly 332 is energized and rotation of the collet 310 is commenced. When the rotational speed of the collet 310 reaches the desired winding speed, the strands are contacted by a spiral assembly and the strand 326 is displaced to be wound about the tubular support 328 upon the mandrel 304 to form the wound forming package 344.

When winding of the forming package 344 is completed, the strand 326 is displaced from contact with the spiral assembly and wound about the first end 308 of the mandrel 304. The operator 312 ceases the winding operation by stopping the rotation of the collet 310 and reducing or releasing the pressure from the chamber 348 to retract the mandrel 304. The operator 312 severs the strand wound about the first end 308 of the mandrel 304 from that of the forming package 344 and removes the waste strand from the first end 308 of the mandrel 304 and the forming package 344 from the mandrel 304.

The methods and apparatus of the present invention will now be illustrated by the following specific, non-limiting example.

EXAMPLE

An endcap as shown in FIGS. 2–5 having twenty generally T-shaped strand engaging members received within corresponding generally T-shaped apertures and having an overall diameter of about 0.29 meters (about 11½ inches) when retracted and about 0.3 meters (about 12 inches) when the strand engaging members were extended was mounted upon a first end of a mandrel. The strand engaging members were extended by injecting about $5.5\times10^5$ to about $6.2\times10^5$ Pa (about 80 to about 90 psia) air into a Bimba pneumatic cylinder as discussed above. Rotation of the collet was commenced and conventional waste glass fiber strand was wound about the endcap for about 5 to about 15 seconds until proper winding speed was attained, then the strand was shifted to wind upon a cardboard tubular support telescoped onto the mandrel of the collet. Strand was wound onto the tubular support for about 6 to about 10 minutes and was then shifted to wind about the first layer of waste strand upon the endcap for about 5 to about 15 seconds. Rotation of the collet was stopped. The pressure was released from the pneumatic cylinder and the strand engaging members were retracted. The waste strand wound about the endcap was easily removed by hand by severing only the portions of strand connecting the waste to the wound package, rather than severing the entire thick band of wound waste strand. This operation was repeated in essentially the same manner about 5 to about 7 times and the waste strand was easily removed from the endcap each time.

From the foregoing description, it can be seen that the present invention provides a simple, economical system and methods for winding forming packages and ergonomically removing waste strand from the winder to reduce labor and waste disposal costs and increase efficiency and productivity.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, I claim:

1. An endcap adapted for mounting upon a mandrel of a collet of a forming package winder, the endcap comprising:

(a) a hub comprising (1) a mounting device for securing a portion of the hub to an end of a mandrel of a collet and (2) a plurality of retainers spaced about a periphery of the hub; and (b) a plurality of strand engaging members, each of the strand engaging members having a strand engaging surface for retaining a strand, wherein each of the strand engaging members is radially displaceable from the periphery of the hub between (1) an extended position in which the strand engaging surface of each strand engaging member projects from the periphery of the hub and (2) a retracted position in which the strand engaging surface of each strand engaging member is adjacent the periphery of the hub, each strand engaging member being retained by a corresponding retainer of the plurality of retainers of the hub.

2. The endcap according to claim 1, wherein each of the retainers of the hub has a flange for retaining a corresponding strand engaging member of the plurality of strand engaging members.

3. The endcap according to claim 1, wherein each of the retainers of the hub has an aperture having a generally T-shaped cross-section for retaining a corresponding strand engaging member of the plurality of strand engaging members.

4. The endcap according to claim 3, wherein each of the strand engaging members has a generally T-shaped cross-section.

5. The endcap according to claim 1, wherein each of the strand engaging members has a flange for being retained by a corresponding retainer of the plurality of retainers of the hub.

6. The endcap according to claim 1, wherein the strand engaging surface of each strand engaging member protrudes from the periphery of the hub.

7. The endcap according to claim 1, wherein each of the strand engaging members includes a biasing device for biasing each of the strand engaging members in the retracted position adjacent the periphery of the hub.

8. The endcap according to claim 7, wherein the biasing device of each strand engaging member is a compressible spring.

9. The endcap according to claim 1, further comprising a pressurizing device for extending each of the strand engaging members into the extended position adjacent the periphery of the hub.

10. A collet comprising a shaft, a mandrel having a first end and a second, opposite end mounted upon the shaft, and an endcap attached to the first end of the mandrel, the endcap comprising:

(a) a hub comprising (1) a mounting device for securing a portion of the hub to an end of the mandrel of the collet and (2) a plurality of retainers spaced about a periphery of the hub; and (b) a plurality of strand engaging members, each of the strand engaging members having a strand engaging surface for retaining a strand, wherein each of the strand engaging members is radially displaceable from the periphery of the hub between (1) an extended position in which the strand engaging surface of each strand engaging member projects from the periphery of the hub and (2) a retracted position in which the strand engaging surface of each strand engaging member is adjacent the periphery of the hub, each strand engaging member being retained by a corresponding retainer of the plurality of retainers of the hub.

11. The collet of claim 10, wherein the mandrel has a plurality of fingers which are radially displaceable between a first, expanded position for engaging and retaining a wound forming package upon the fingers of the mandrel and a second, collapsed position for releasing the wound forming package from the finger of the mandrel.

12. A winder comprising a support, a collet mounted upon the support, and a motor assembly for rotating the collet upon which a forming package is wound, the collet comprising a shaft, a mandrel having a first end and a second, opposite end mounted upon the shaft, and an endcap attached to the first end of the mandrel, the endcap comprising:

(a) a hub comprising (1) a mounting device for securing a portion of the hub to the first end of the mandrel and (2) a plurality of retainer spaced about a periphery of the hub: and (b) plurality of strand engaging members, each of the strand engaging members having a strand engaging surface for retaining a strand, wherein each of the strand engaging member is radially displaceable from the periphery of the hub between (1) an extended position in which the strand engaging surface of each strand engaging member projects from the periphery of the hub and (2) a retracted position in which strand engaging surface of each strand engaging member is adjacent the periphery of the hub, each strand engaging member being retained by a corresponding retainer of the plurality of retainers of the hub.

13. A system for winding a forming package, the system comprising:

(a) a plurality of generally continuous fibers;

(b) an alignment device for gathering and aligning the plurality of fibers to form at least one generally continuous strand;

(c) a winder comprising a support, a collet mounted upon the support, and a motor assembly for rotating the collet, the collet comprising a shaft, a mandrel having a first end and a second, opposite end mounted upon the shaft, and an endcap attached to the first end of the mandrel, the endcap comprising:

(a) a hub comprising (1) a mounting device for securing a portion of the hub to the first end of the mandrel and (2) a plurality of retainers spaced about a periphery of the hub; and (b) a plurality of strand engaging members, each of the strand engaging members having a strand engaging surface for retaining a strand, wherein each of the strand engaging in members is radially displaceable from the periphery of the hub between (1) an extended position in which the strand engaging surface of each strand engaging member projects from the periphery of the hub and (2) a retracted position in which the strand engaging surface of each strand engaging member is adjacent the periphery of the hub, each strand engaging member being retained by a corresponding retainer of the plurality of retainers of the hub.

14. The system according to claim 13, wherein the fibers are glass fibers.

15. The system according to claim 13, wherein the mandrel has a plurality of fingers which are radially displaceable between a first, expanded position for engaging and retaining a wound forming package upon the fingers of the mandrel and a second, collapsed position for releasing the wound forming package from the fingers of the mandrel.

16. The system according to claim 13, wherein at least a portion of a surface of the mandrel is encased by a removable tubular support, a portion of the strand being wound about a surface of the tubular support to form the wound forming package.

* * * * *